US007421946B1

(12) United States Patent
Pontus et al.

(10) Patent No.: US 7,421,946 B1
(45) Date of Patent: Sep. 9, 2008

(54) TWO STAGE OIL FILTER PRESS

(76) Inventors: John J. Pontus, 3212 Newcastle Dr., Rock Hill, SC (US) 29732; Bradley M. Robbins, 1798 Millen Rd., Chester, SC (US) 29706

( * ) Notice: Subject to any disclaimer, the term of this patent is extended or adjusted under 35 U.S.C. 154(b) by 0 days.

(21) Appl. No.: 11/807,847

(22) Filed: May 30, 2007

(51) Int. Cl.
*B30B 7/04* (2006.01)
*B30B 15/30* (2006.01)
*B30B 15/16* (2006.01)

(52) U.S. Cl. ..... 100/232; 100/49; 100/52; 100/215; 100/216; 100/245; 100/269.01; 100/269.17; 100/902; 100/906

(58) Field of Classification Search ..... 100/98 R, 100/214, 215, 216, 232, 226, 240, 245, 269.01, 100/269.14, 269.17, 902, 906, 43, 49, 50, 100/52
See application file for complete search history.

(56) References Cited

U.S. PATENT DOCUMENTS 2,932,247 A * 4/1960 Thompson ..... 100/232
3,762,311 A * 10/1973 Friedman et al. ..... 100/49
4,213,110 A 7/1980 Holce ..... 335/207
4,316,145 A 2/1982 Tann ..... 324/208
4,601,238 A * 7/1986 Davis et al. ..... 100/45
4,658,719 A 4/1987 Jackson et al. ..... 100/218
4,787,308 A 11/1988 Newsom et al. ..... 100/50
5,007,337 A * 4/1991 Newsom ..... 100/188 R
5,182,988 A 2/1993 Styfhoorn ..... 100/98 R
5,203,261 A 4/1993 Davis ..... 100/42
5,463,596 A 10/1995 Siefken ..... 367/98
5,678,478 A 10/1997 Goyal et al. ..... 100/52
5,953,976 A 9/1999 Bueter ..... 91/1
5,983,788 A * 11/1999 Wernimont ..... 100/125
6,546,855 B1 * 4/2003 Van Der Beek et al. ..... 100/39

* cited by examiner

*Primary Examiner*—Jimmy T Nguyen
(74) *Attorney, Agent, or Firm*—Joseph T. Guy; Nexsen Pruet, LLC

(57) ABSTRACT

A two stage oil filter press having a housing with a precompression chamber and a main compression chamber together with a vertically reciprocating precompression ram and a horizontally reciprocating main compression ram powered by individual fluid cylinders. A feed chute with a scoop is raised through a void in the hopper created by a baffle which insures feeding a measured quantity of spent oil filters to the precompression chamber through a feed window. A main compression chamber is defined at the lower end of the precompression chamber by the lower horizontal end surface of the precompression ram, the floor, a pair of side walls of the precompression chamber, the thrust end of the main compression ram and a discharge door.

11 Claims, 14 Drawing Sheets

TWO STAGE OIL FILTER PRESS

BACKGROUND OF THE INVENTION

Used oil filters are salvaged for purpose of recycling the residue oil and the metal. Various presses have been proposed for compressing such used oil filters into compact brick shaped bundles or bales. U.S. Pat. No. 5,007,337 discloses a waste material baler having a reciprocable main compression plunger functioning to compress waste material and an ejection plunger for removing the compressed bale from the compression chamber. U.S. Pat. No. 5,203,261 discloses a can baling machine having a vertical loading chute, a horizontally reciprocatable auxiliary plunger and a horizontally reciprocatable main plunger disposed at a right angle to the auxiliary plunger. The cans pre-pressed by the auxiliary plunger are sheared by the main plunger creating metal fragments which must be carefully filtered from the oil salvaged in an oil filter recycling operation. Previously designed oil filter presses have not made adequate provisions for problems that occur due to oversize foreign objects and materials that cannot be sheared, which are mistakenly mixed with used oil filters. In a continuously operating oil filter press facility the used oil filters are normally dumped into the feed hopper and fed into a compression chamber without thorough inspection for foreign objects. Thus foreign items, such as various used automotive components, may be fed without detection into the oil filter press. Removal of oversize foreign components from a jammed press is typically difficult and time consuming.

SUMMARY OF THE INVENTION

The two stage oil filter press has a housing with vertical walls forming a precompression or prepress chamber with a rectangular cross section in which a precompression or prepress ram is reciprocated vertically by a linear fluid actuator. A measured quantity of used oil filters previously deposited in a hopper are raised, through a void created by a baffle, in a scoop connected for vertical movement with the precompression ram and loaded into the precompression chamber through a feed window in one of the vertical side walls of the housing which is open when the precompression ram is in its raised position. Downward movement of the precompression ram compresses the used oil filter cans against a horizontal floor constituting part of a parallelepiped shaped main compression chamber formed by the floor, the flat horizontal end of the precompression cylinder, the lower portions of two parallel vertical walls of the precompression chamber, a sliding discharge door and a vertical end face of a main compression ram mounted for horizontal reciprocation to further compress the cans to form a dense block of recycled compressed cans. The discharge opening is larger in vertical dimension than the face of the main compression ram. A computerized control system operates the press in a continuous cyclic manner as long as used oil filters are supplied to the feed hopper and oversize foreign objects do not cause a stoppage. A clean out window is provided for removing foreign objects and shear pins are provided to prevent damage to a loading chute feeding used filters to the precompression chamber. A pressure rise in the prepress operating cylinder prior to its passing below the feed window automatically causes the control system to retract the prepress cylinder and change press operation from automatic to manual. An audible signal is activated to alert the operator.

DESCRIPTION OF THE DRAWINGS

The invention is illustrated in the accompanying drawings, in which.

DETAILED DESCRIPTION OF THE INVENTION

Figure 19:
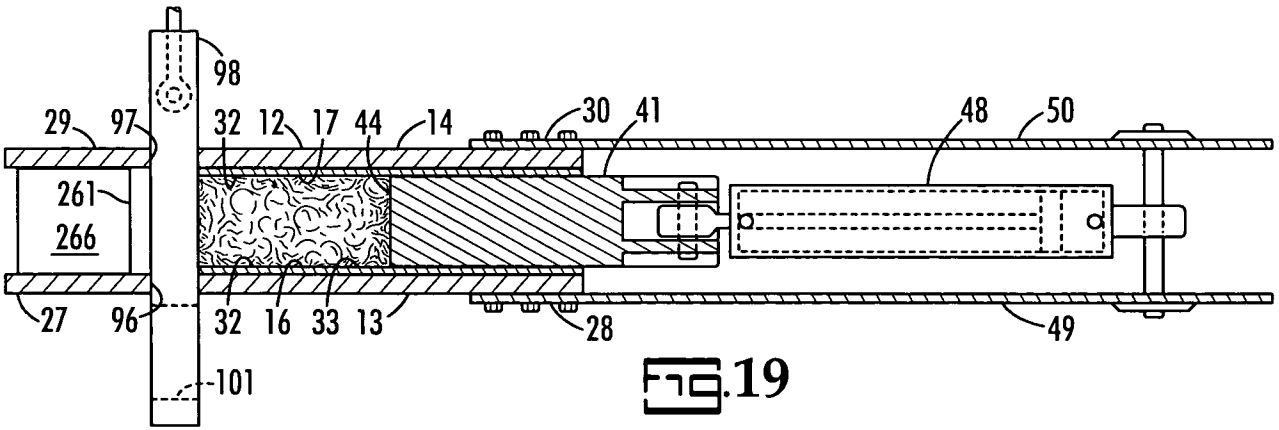
FIG. 19 is a section taken on line 19-19 in FIG. 2.

FIGS. 1 through 4 of the drawings illustrate a first embodiment of the oil filter press 11 which includes a rigidly constructed steel housing 12. An understanding of the construction of the housing is facilitated by reference also to FIGS. 9 and 10 which show a first pair of relatively wide parallel vertical side walls 13, 14 which include thin linings or wear panels 16, 17, 18, 19. The upper ends of the thin wear panels 16, 17, which are integrally secured to and become this confronting sides of the sidewalls 13, 14, terminated at the level of the lower end of a feed window 34 in side wall 14 and terminate at their lower ends at the upper surface of a bottom wall or floor 31. The linings 18, 19 are shown in FIG. 19. The wide side walls 13, 14 have a rigid right angle welded connection to a second pair of narrower parallel vertical side walls 21, 22. The two pairs of side walls 13, 14, 21, 22 form a vertically elongated precompression or prepress chamber 26 having a rectangular cross section. Referring also to FIG. 19, the side walls 13, 14 have end portions or wings 27, 28, 29, 30 which extend beyond their junction with the side walls 21, 22. A flat horizontal wall 31, welded to the sidewalls 13, 14, forms the bottom of the preptess chamber 26 and also the bottom wall of a main compression chamber 33. The bottom wall or floor 31 is reinforced by trusses 32 welded to the side walls 13, 14 and the underside of the bottom wall 31. Spent oil filter cans are fed into the prepress chamber 26 through the feed window 34 in side wall 14 and the laterally opposite side wall 13 includes a clean out window 36 by which oversize foreign objects, which do not pass through the feed window 34, can be conveniently removed from the housing 12. A cover 37 for the clean out window 36 is releasable secured to the side wall 13 by suitable cap screws 37'. The lower end 38 of the side wall 21 terminates in a horizontal edge spaced above the horizontal floor 31 to thereby define an opening 39 for a main compression ram 41 shown in FIGS. 2, 19 and 20. The side wall 22 terminates at its lower end 42 in a horizontal plane spaced a greater distance above the floor 31 than the lower end 38 of the side wall 21, thereby providing a relatively large discharge opening 43 for the main compression chamber 33; which opening is substantially larger than the opening 39 for the 41 main compression ram. The main compression ram 41 is shifted between its retracted position, shown in FIGS. 2 and 19, in which its vertical end surface 44 aligns with the inner face of the side wall 21 of the housing 12, and its extended position by a linear actuator or fluid cylinder 48 having its cylinder rod pivotally connected to the ram 41 and its cylinder end pivotally connected to mounting brackets 49, 50 rigidly secured to the housing walls 13, 14.

Figure 2:
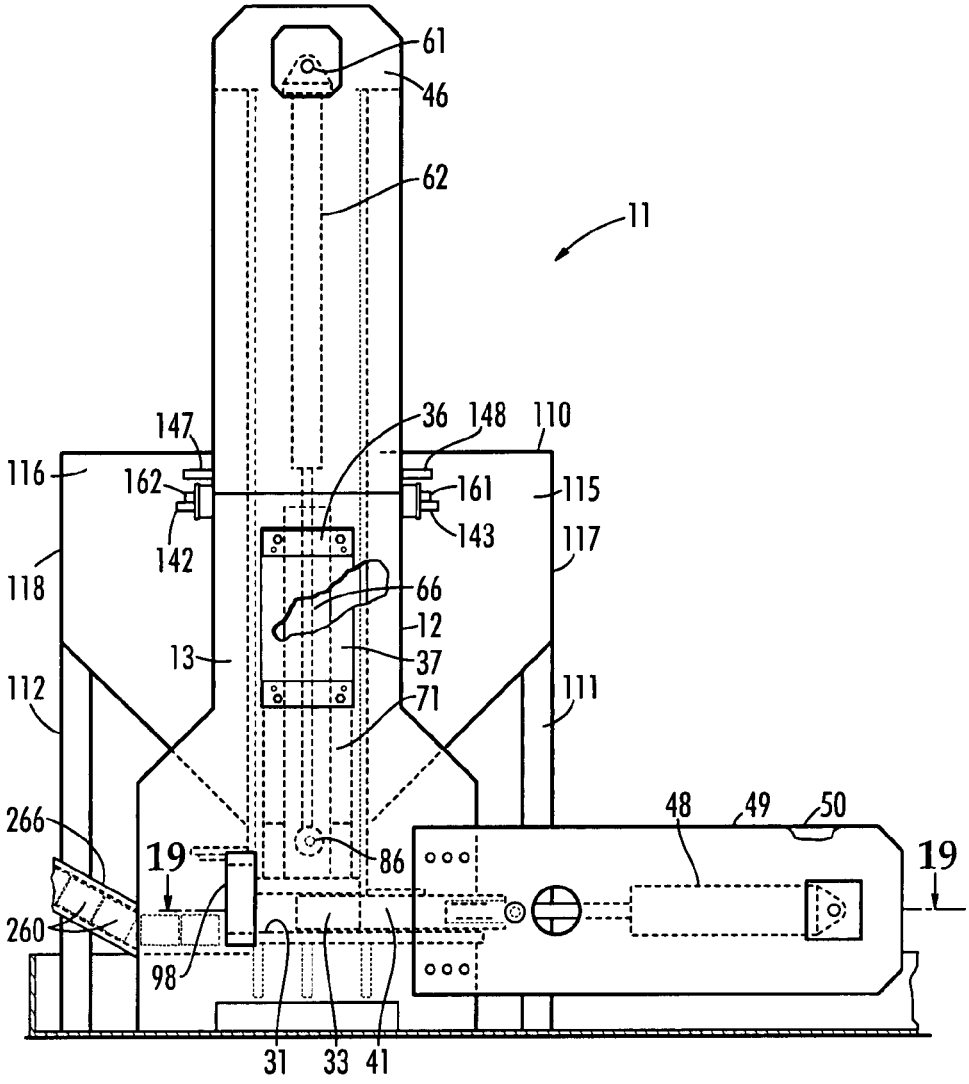
FIG. 2 is a rear view of the oil filter press shown in FIG. 1.
Figure 9:
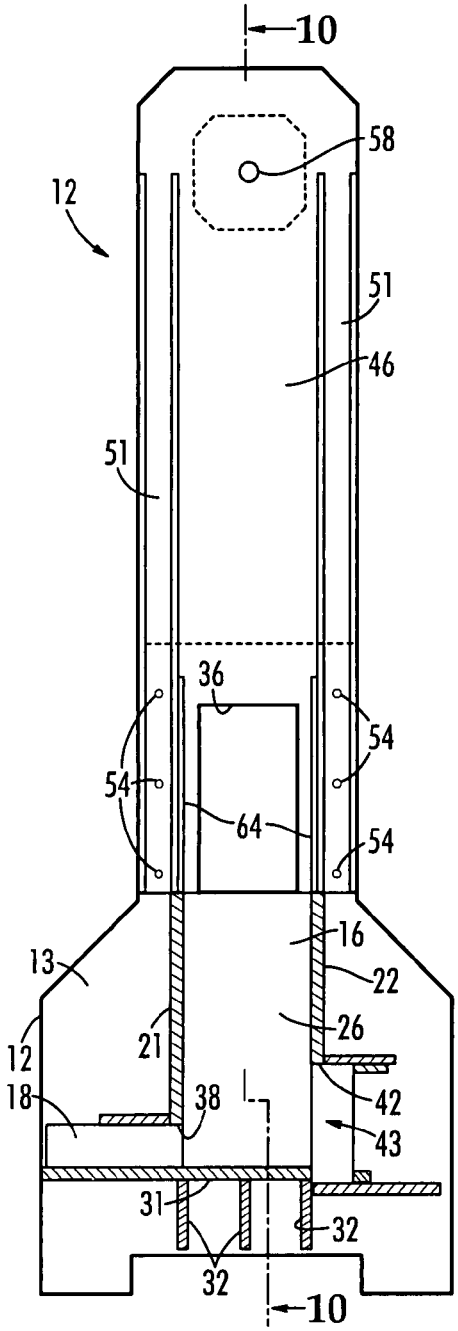
FIG. 9 is a vertical section of the main housing.
Figure 10:
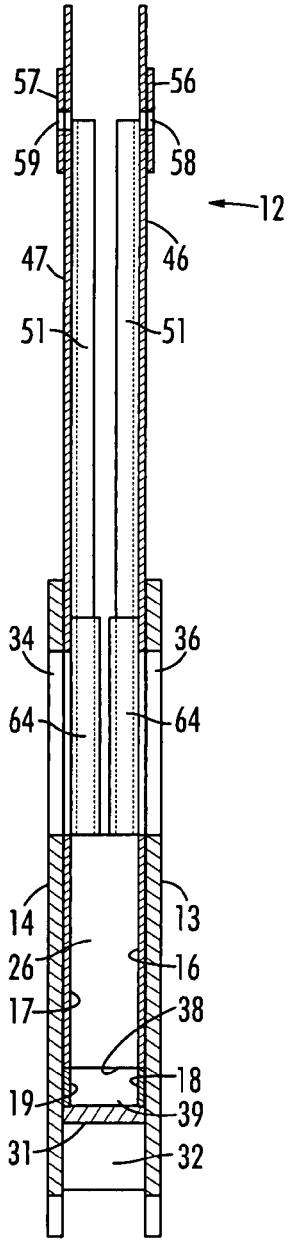
FIG. 10 is a section taken on line 10-10 in FIG. 9.

As shown in FIGS. 9 and 10, the parallel vertical side walls 21, 22 of the housing 12 terminate at their upper ends near the bottom of the feed opening 34 and clean out window 36, respectively. A pair of parallel vertical fluid cylinder support members or panels 46, 47, and vertically extending reinforcing angle irons 51 welded thereto, are rigidly secured by fasteners 54 to the associated side walls 13, 14. Reinforcing plates 56, 57 for the aligned bores 58, 59 in the upper ends of the panels 46, 47, for a pin 61 supporting a linear actuator in the form of a fluid actuator or prepress cylinder 62, are welded to the laterally outer sides of the support panels 46, 47, respectively. A guide wear plate 64 is welded to each of the angles 51. As shown in FIG. 2, the rod 66 of the prepress or precompression cylinder 62 is pivotally connected to a steel prepress or precompression ram 71 near its lower end. As shown in FIGS. 2, 11, 12, 13 the prepress ram 71 is a weldment including elongated vertical side members 72, 73, 74, 76, 77, trusses 78, 79 and cylinder rod mounting brackets 81, 82 having aligned bores 83, 84 for receiving the pivot pin 86 for connecting the piston rod 66 of the fluid actuator 62 to the prepress ram 71. The bottom end plate 86 presents a flat horizontal bottom surface 87. A closure panel 91 is welded to the confronting edges of vertical side members 76, 77 and the truss 79 to prevent spent oil filters from passing through the feed opening 34 into the interior of the prepress ram 27 when it is along side the fee opening 34.

As shown in FIG. 19, the side walls 13, 14 of the housing 12 have door guide structure in the form of rectangular openings 96, 97 for guiding a slidable discharge door 98 which is horizontally shiftable between the closed position shown in FIG. 19, in which it forms a side wall of the main compression chamber 32, to an open position in which a discharge window 101 of the door 98 is aligned with and is coextensive with the discharge opening 43 of the main compression chamber 33. As will be noted, the discharge window 101 and the discharge opening 43 have a substantially greater the vertical height than the opening 38 for the main compression ram 41. Thus the discharge opening afforded by the discharge window 101 of the sliding door 98 permits discharge of oversize compressed oil filter bales or bricks which may contain foreign material. Such foreign material may not permit the precompression ram 71 to extend downward to its normal full stroke position shown in FIGS. 2 and 8.

Figure 7:
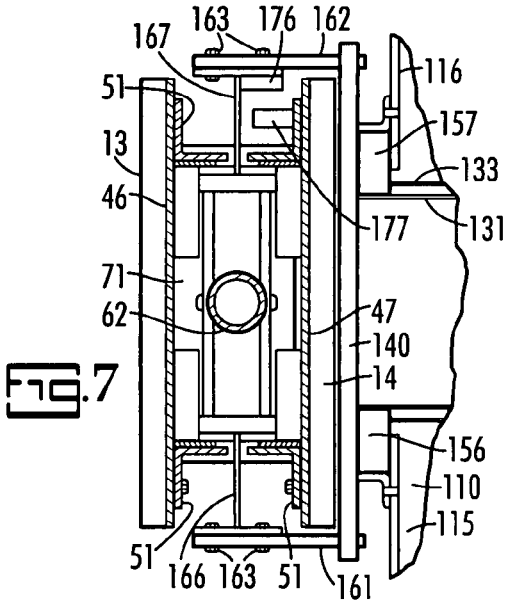
FIG. 7 is a section taken on line 7-7 in FIG. 6.
Figure 14:
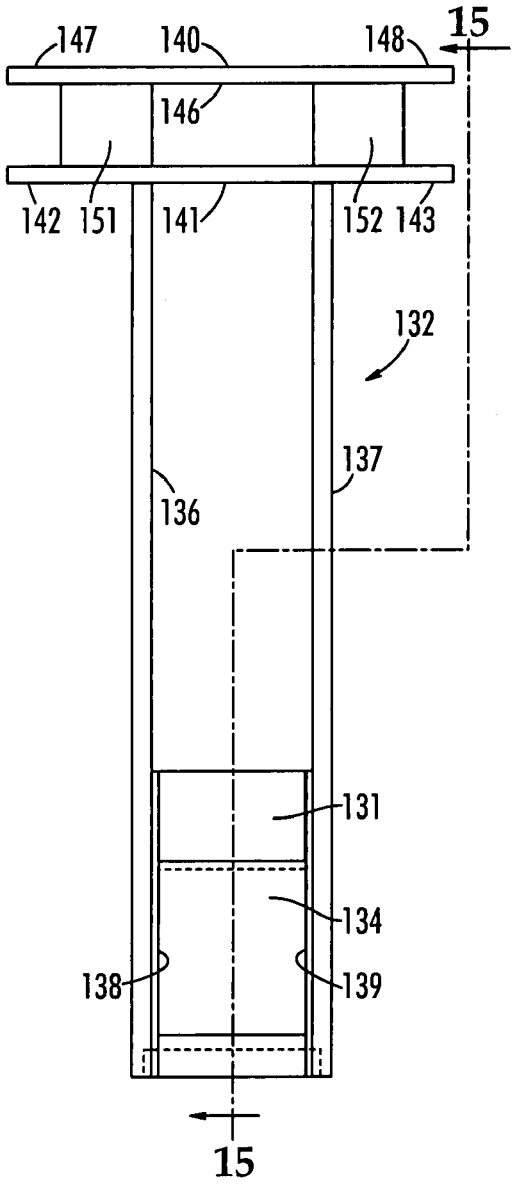
FIG. 14 is a rear view of the feed chute.
Figure 15:
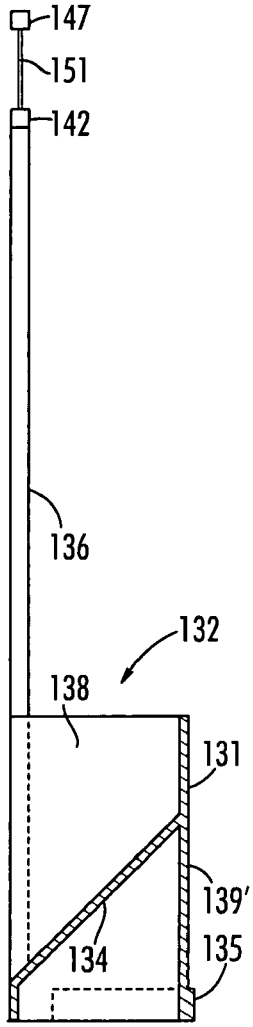
FIG. 15 is a view taken on line 15-15 in FIG. 14.
Figure 18:
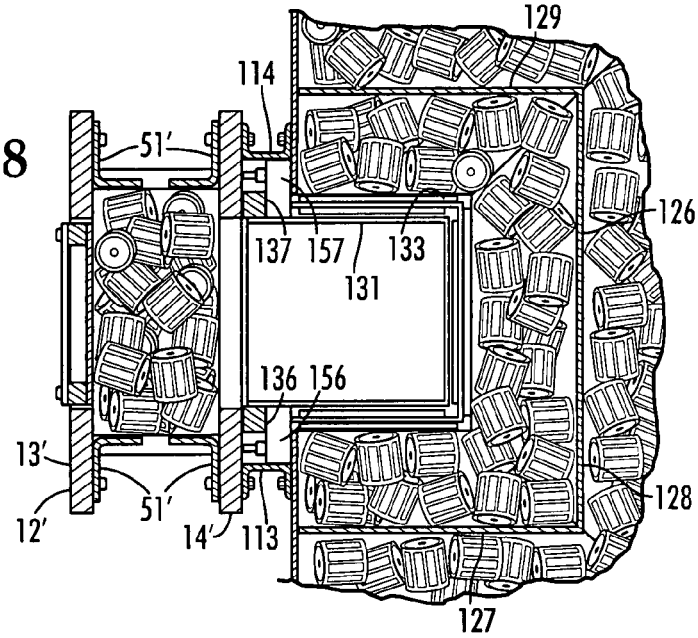
FIG. 18 is an enlarged section taken on line 18-18 in FIG. 17.

Referring to FIGS. 1 through 5, a feed hopper 110 for the press 11 is supported vertically by a pair of legs 111, 112 and latterly by channels 113, 114 securing the hopper 110 to the side wall 14 by fasteners, illustrated in FIG. 18. The feed hopper 110 includes vertical side walls 115, 116, 117, 118 and inclined bottom walls or panels 119, 129, 121. The hopper 110 also includes a square cornered vertical passageway or shaft 122 at its lower end and a pair of horizontal struts 123, 124 which brace the legs 111, 112. A U-shaped baffle 126 formed of vertical panels 127, 128, 129 is rigidly secured to the vertical hopper walls 115, 116 and extending downwardly from the top of the hopper 110 terminating above the sloping bottom walls 119, 129, 121. The baffle 126 is larger in horizontal cross section than the shaft 122 and scoop 131. The shaft 122 serves to vertically guide a scoop 131 of a feed chute 132 and a complementary skirt 133 telescopically connected to the scoop 131, the skirt 133 being positioned between the shaft 122 and the scoop 131. An outwardly projecting flange 135 at the bottom of the walls 138, 139, 139' of the scoop 131 and an inwardly projecting flange 135' at the top of the skirt 133 limit telescopic extension of the scoop 131 and the skirt 133. Referring also to FIGS. 14 and 15 the scoop 131 is open at its top and one side; and it has a bottom 134 sloping down to the lower end of the open side. The feed chute 132, disposed in juxtaposed relation to housing wide wall 14, includes a pair of parallel vertical guide rails 136, 137 secured by welding to the exterior of the laterally opposite sides 138, 139 of the scoop 131. A motion transmitting bracket 140 is provided at the upper end of the guide rails 136, 137 which includes a first horizontal bar 141 welded to the upper ends of the rails 136, 137 and having ends 142, 143 extending laterally outward in opposite horizontal directions from the guide rails 136, 137 and a second horizontal bar 146 spaced above and parallel to bar 141 with ends 147, 148 co-extensive with the ends 142 and 143, respectively, of the first bar 141. The bars 141, 146 are rigidly interconnected by vertically extending plates 151, 152 welded at their lower and upper edges to the bars 141, 146. As shown in FIG. 14, the end portions of the bars 142, 143, 147, 148 extend outwardly beyond the rails 136, 137 and beyond the plates 151, 152. As shown in FIGS. 7 and 18, the skirt 133 is welded to a pair of vertically extending guide bars 156, 157, which lie in juxtaposed relation to the guide rails 136, 137 of the feed chute 132.

Figure 3:
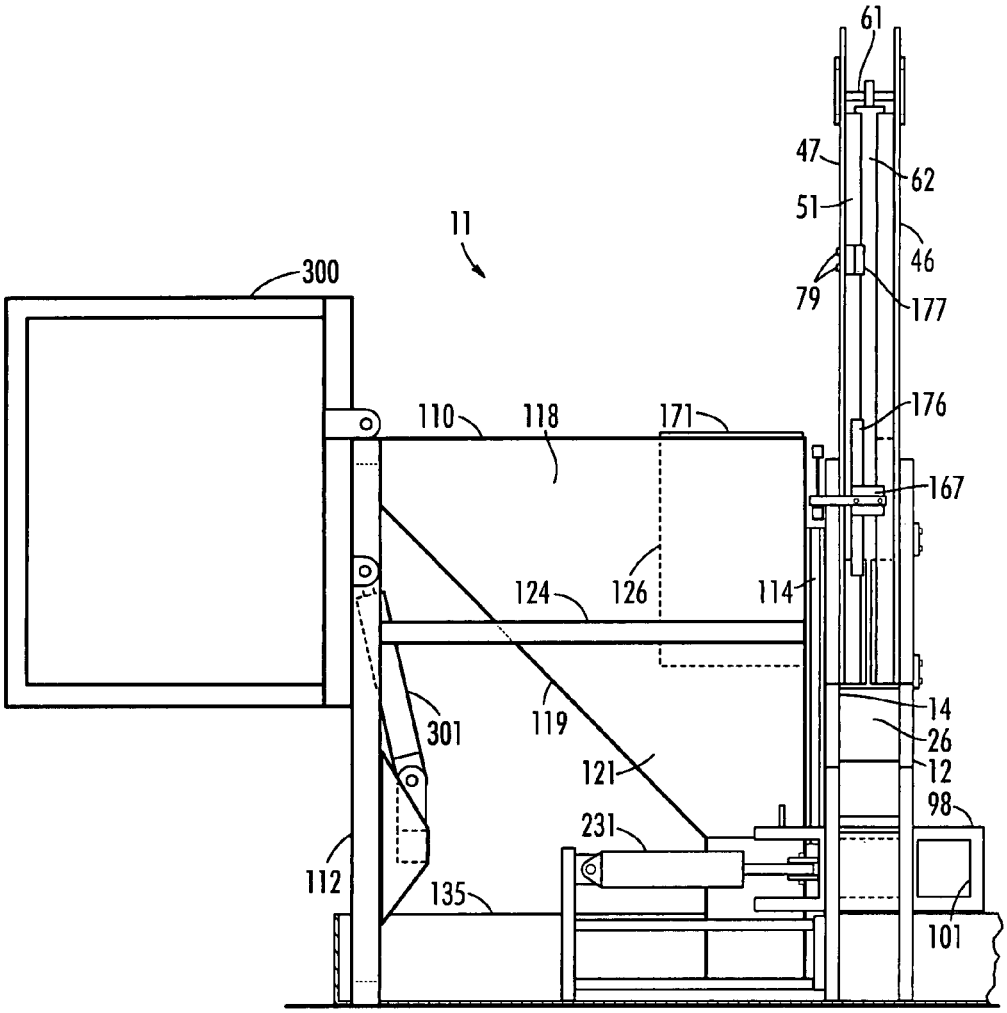
FIG. 3 is a right side view of the oil filter press shown in FIGS. 1 and 2.
Figure 12:
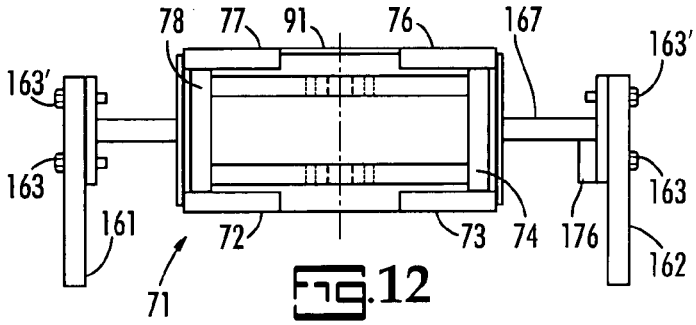
FIG. 12 is a top view of the pre-compression ram shown in FIG. 11.
Figure 11:
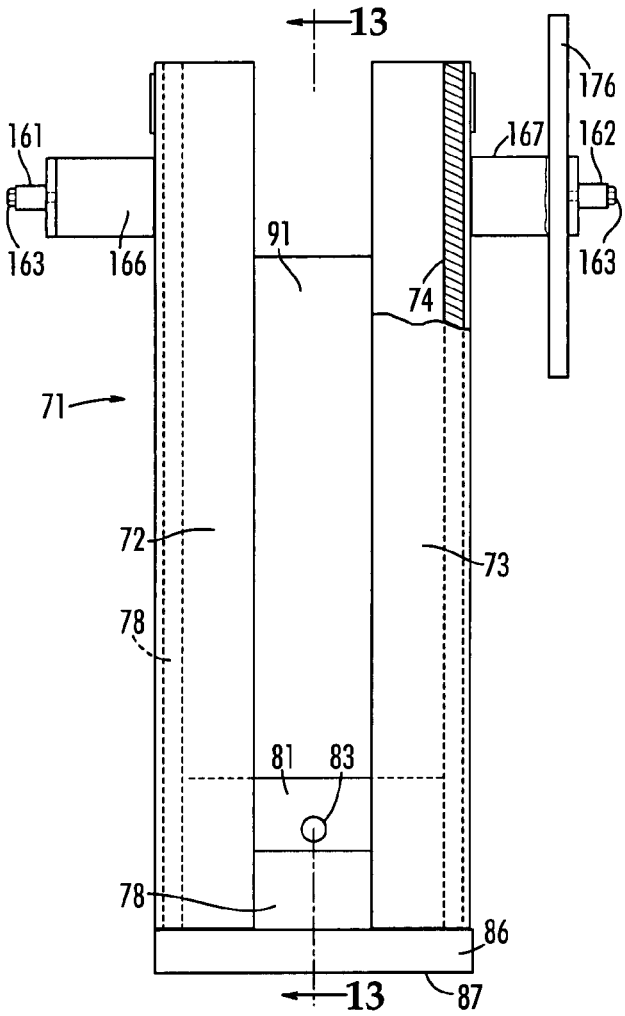
FIG. 11 is a side view of the pre-compression ram with parts broken away for illustration purposes.
Figure 13:
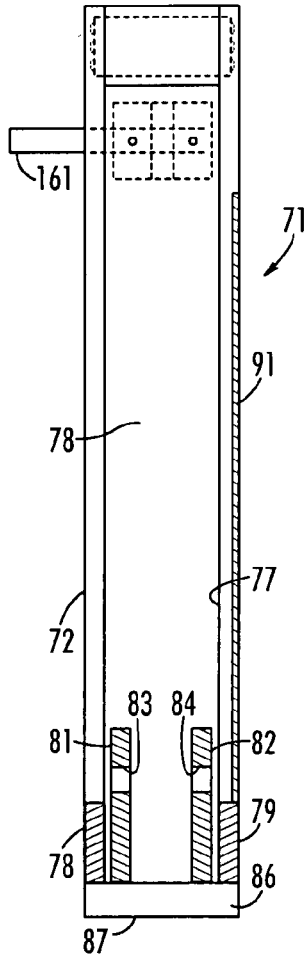
FIG. 13 is a side view taken on line 13-13 in FIG. 11 with parts broken away for illustration purposes.

The feed chute 132 is raised and lowered by a lost motion connection with the prepress ram 71. As shown in FIGS. 11, 12 and 13 a pair of parallel arms 161, 162 are mounted at the same height to laterally opposite sides walls 78, 74 of the prepress ram 71. As shown in FIGS. 1, 2, 3, 6, and 17, the arm 161 extends horizontally so as to be positioned vertically between first end portions 148, 143 of the bars 146, 141 and the arm 162 extends horizontally so as to be positioned vertically between second end portions 147, 142 of the bars 146, 141. The arms 161, 162 are secured by connectors, including cap screws 163 and threaded brass shear pins 163', to T-shaped bracket 166, 167 welded to the prepress ram side walls 78, 74, respectively. As shown in FIGS. 3, 11 and 12, a vertically extending steel bar 176 is welded to the bracket 167 and functions to operate a proximity switch 177 which is rigidly secured with its insulating mounting pad 178 to the angle 51 reinforcing panel 47 by a pair of fasteners 179. The purpose and function of the proximity switch 177 is hereinafter explained.

Figure 20:
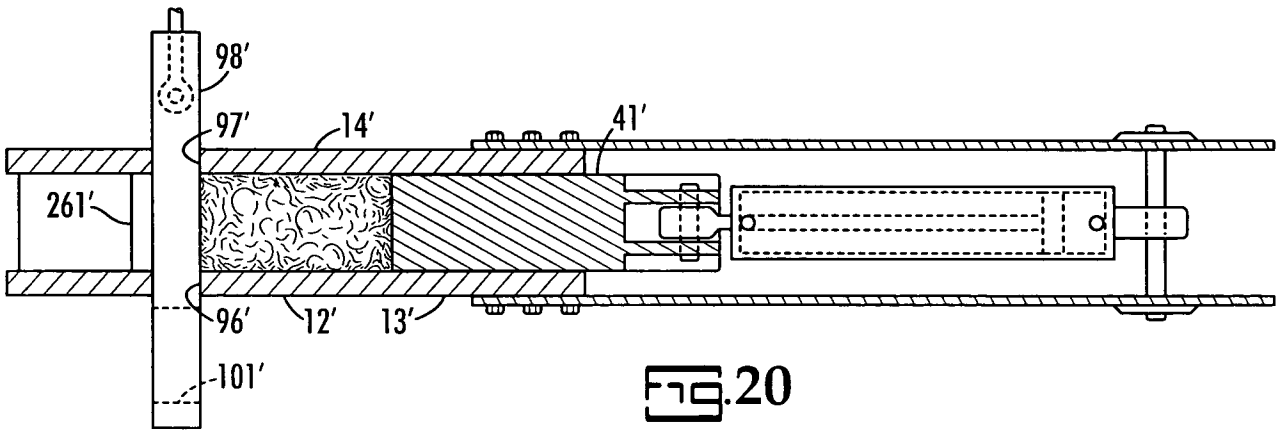
FIG. 20 is a view similar to FIG. 19 but showing the second embodiment of the invention.

FIGS. 16, 17, 18 and 20 illustrate a second embodiment of the invention which does not provide wear panels in the compression chambers 26, 33. In the second embodiment, the support panels 46' 47' rest at their lower ends on top of the side walls 13', 14' of the housing 12'. The support panels 46', 47' are supported by angle irons 51' secured by fasteners 54' to confronting sides of the housing side walls 13' 14'. FIG. 20, which is a section taken of the housing 12' of the second embodiment of the invention, shows the main compression ram 41' at the beginning of its compression stroke with the sliding door 98' in a closed portion.

Figure 1:
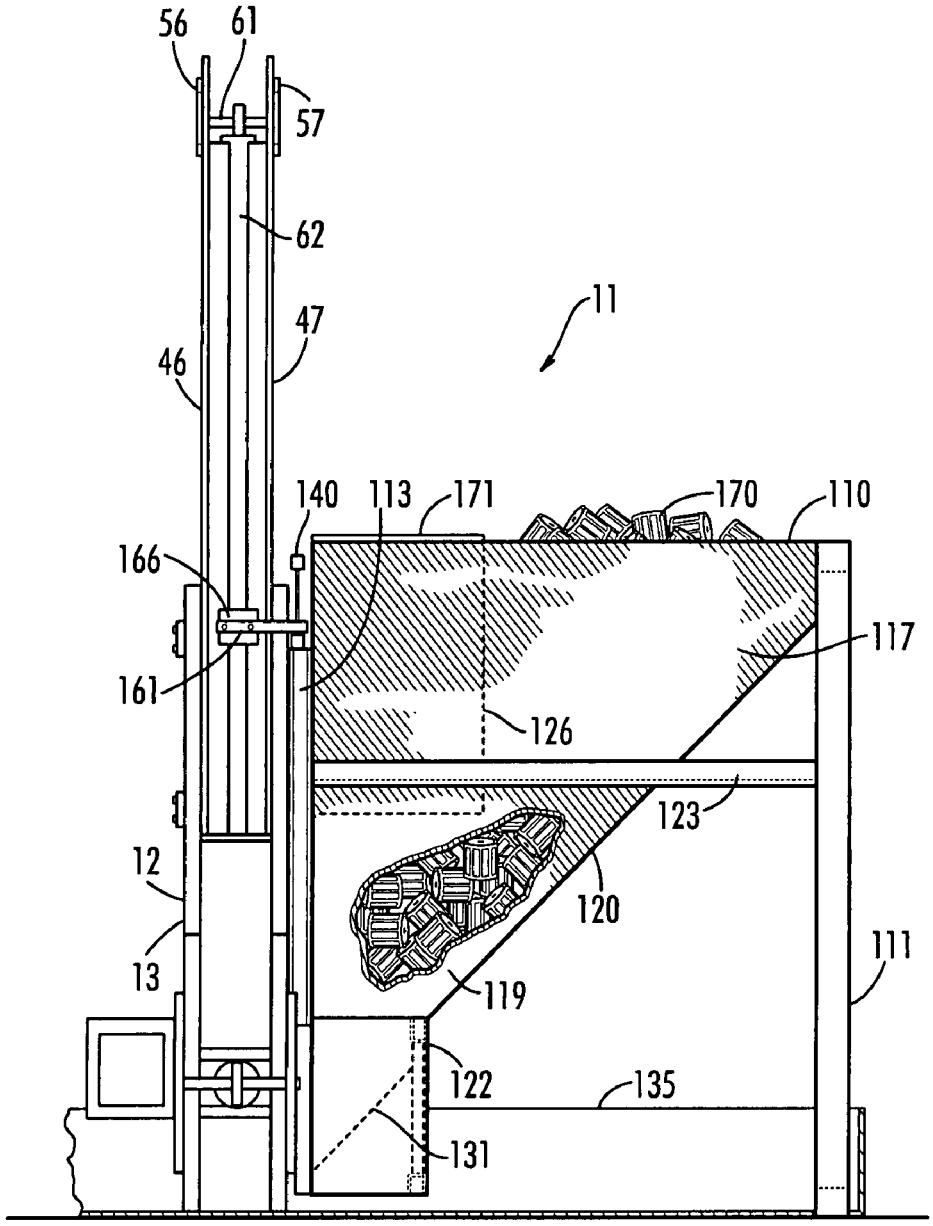
FIG. 1 is a left side view of the oil filter press.
Figure 5:
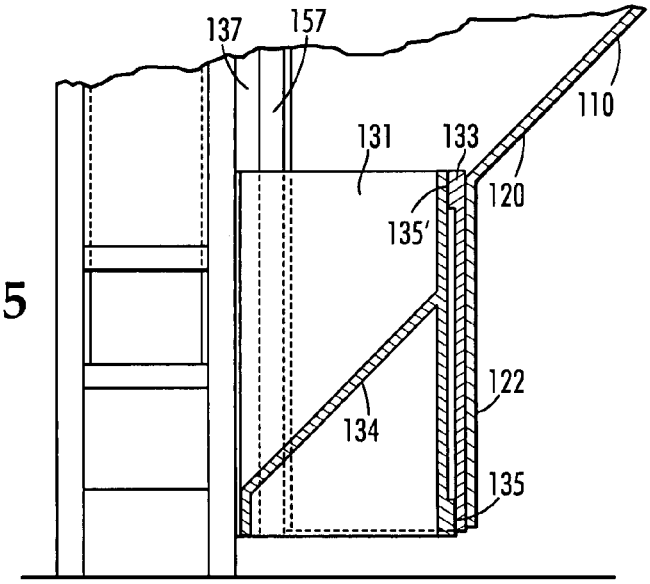
FIG. 5 is a vertical section take on line 5-S in FIG. 4 showing the loading shute and its blind skirt.
Figure 6:
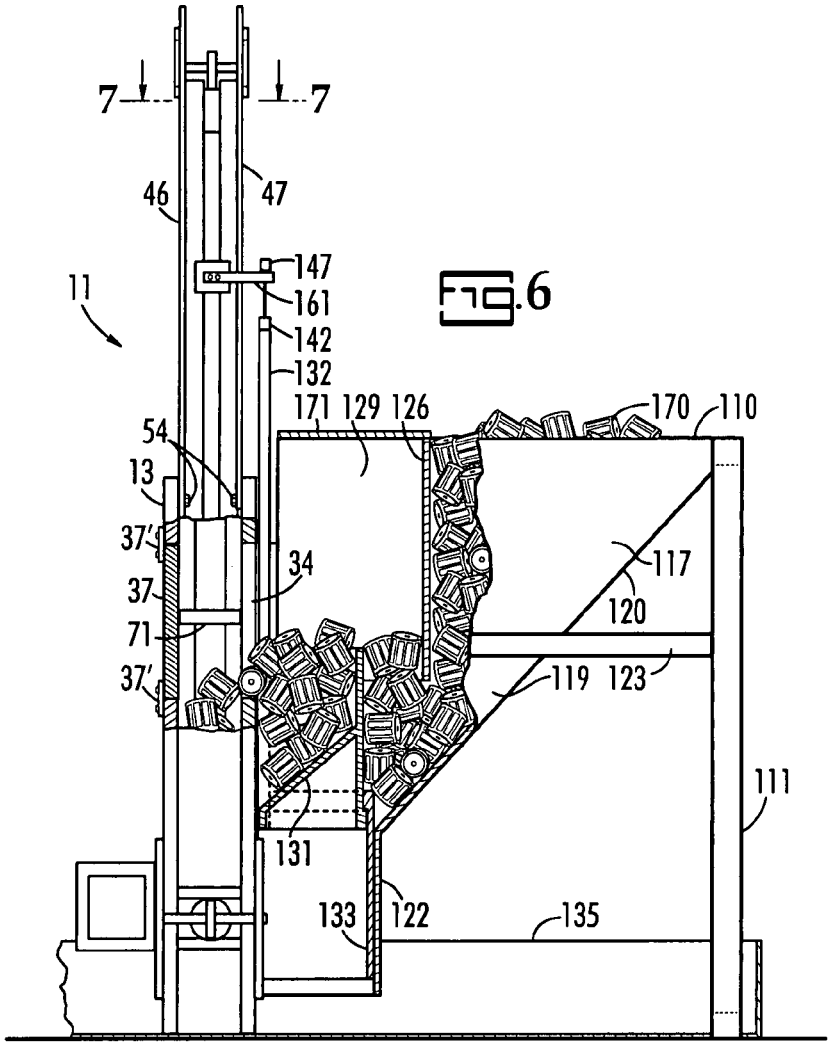
FIG. 6 is a left side view of the oil filter press of FIGS. 1-4 with parts broken away for illustration purposes.

Used or spent oil filters 170 may be dumped into the hopper 110 by a front end loader or the like or by an optional power operated loader 300, shown in FIG. 3, which is powered by a fluid actuator or cylinder 301. A guard 171 on top of the baffle 126 prevents the filters 170 from being dumped into the interior of the baffle 126. The baffle 127 helps to regulate the amount of spent filters picked up by the scoop 131 and facilitates dumping of spent filters during a continuous or automatic operation of the press 11. At the start of a cycle of press operation, the prepress ram 71 is in its extended or compression position, as shown in FIG. 1, in which position the scoop 131 and its skirt 133 are within the shaft 122 at the bottom of the hopper as shown in FIGS. 1 and 5 and the panel 91 on the side of the prepress ram 71 closes the feed window 34. As the scoop 131 is raised by upward retraction of the prepress ram 71, the excess filters will fall into the space between the scoop 131 and the baffle 126 and the measured load of spent filters will fall through the then open feed window 134 into the prepress chamber 26. The sloping bottom 134 facilitates complete discharge of spent oil filters into the prepress chamber 26 by the time the prepress cylinder 62 is fully retracted. Oil compressed from the spent filters is accumulated in a collection sump 135 in which the press 11 is positioned. The clearance between the housing 12 and the main compression ram 41 and between the door 98 and the housing 12 allow oil compressed from the spent filters to pass to the collection sump 135.

Figure 21:
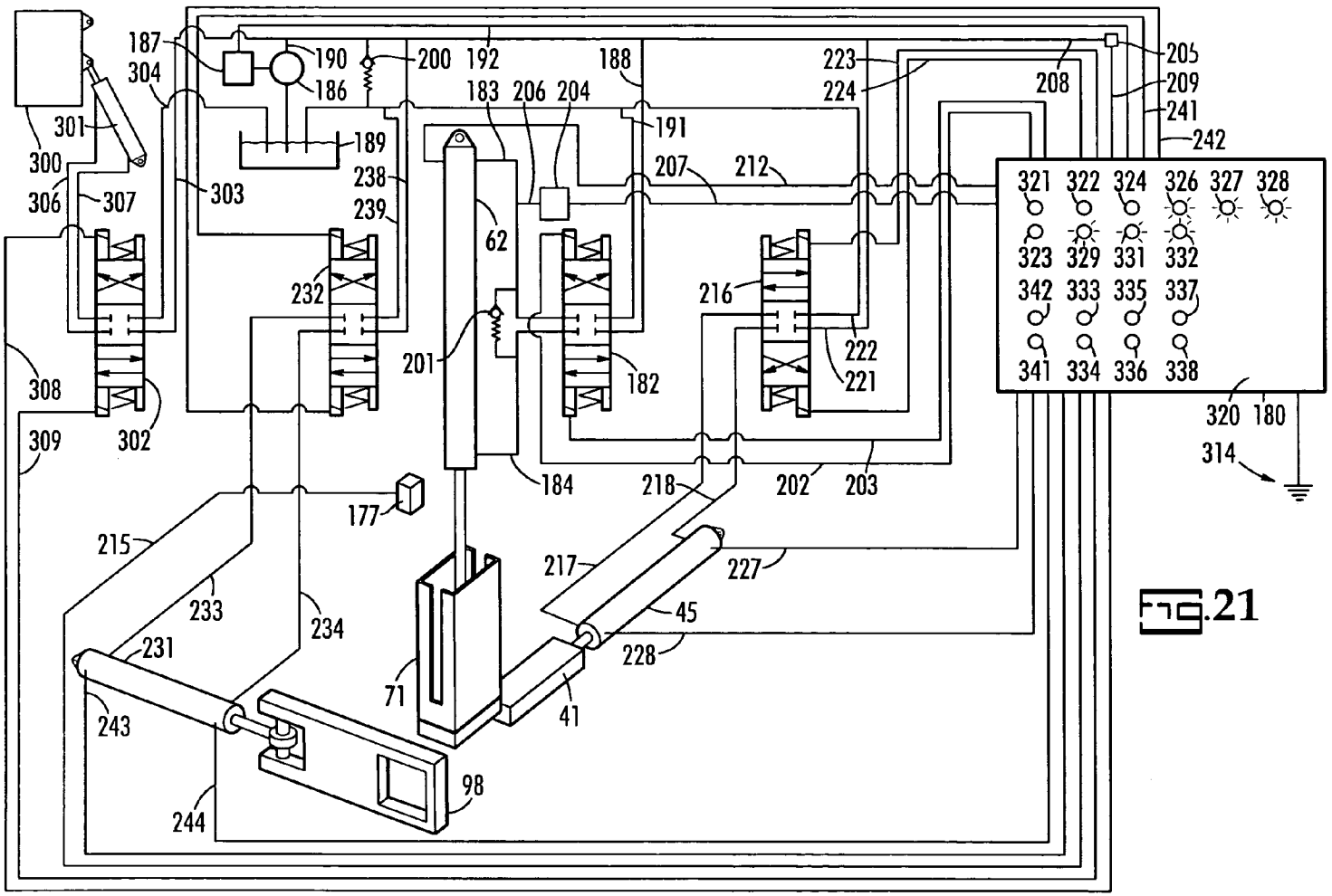
FIG. 21 is a schematic of the control system for the oil filter press.

FIG. 21 shows a computerized control system having a control center 180. A pressure compensated fluid pump 186 driven by electric motor 187 supplies pressure fluid to the cylinders 45, 62, 231 and 301 through its pump output line 190. The pump 186 automatically supplies a higher fluid output at low delivery pressure which substantially shortens the press cycle time. The prepress cylinder 62 is connected to a solenoid valve 182, having extend, contract and hold positions of adjustment by fluid lines 183, 184 and the solenoid valve 182 is connected to the fluid pump 186 by a fluid conduit 118 and to a sump 189 by a fluid conduit 191. The pump driving motor 187 is connected to the control center 180 by an electric control line 91. Relief valves 200, 201 for the pump 187 and the prepress cylinder 62 open at 3000 psi and 3200 psi, respectively. The solenoid valve 182 is connected to the control center 180 by electric lines 202, 203. A pressure sensor 204 is connected to fluid conduit 183 by conduit 206 and to the control center by a signal transmitting line 207. An internal piston position sensor, not shown, at the closed upper end of the prepress cylinder 62 is connected to the control center 180 by a signal line 212. The proximity sensing switch 177 is connected to the control center 180 by a control line 215 and as long as the steel bar 176 is adjacent to it, the control center is programmed to adjust the prepress cylinder control valve 182 its contract position if fluid delivery pressure exceeds 150 psi and to switch from automatic control to manual control. This condition will occur if a foreign object lodges in the feed window 34 and blocks downward movement of the prepress ram 71. The control system reacts to a relatively low pressure to prevent shear damage to the press. Once the lower end of the prepress ram 71 descends below the feed window 34, the proximity switch does not sense the presence of the bar 176 and the control center 180 circuit will automatically stop extension of the prepress cylinder upon the pressure sensor 204 signaling the control center 180 that the pressure in the prepress cylinder 62 reaches 3000 psi, at which pressure the control system adjusts the valve 182 to the hold position. A relief valve 201 for the extension side of the cylinder is also set at 3000 psi. A system relief valve 200, connected to the pump discharge line 190, is set at 3200 psi to provide system protection. A system pressure sensor 205 is connected to the pump discharge line 190 through conduit 208 and to the control center by a signal delivery lead 209. When the pressure sensor 205 senses 3200 psi, the control center 180 places the control valves in their hold position and the operating system in a manual operating mode.

A solenoid valve 216 having extend, contract and hold positions of adjustment, is connected to the compression ram cylinder 45 by fluid lines 217, 218 and to the pressure side of the pump 186 and the reservoir 189 by fluid lines 221, 222, respectively. The solenoid valve 216 is connected to the control center 180 by electric lines 223, 224. Position sensors in opposite ends of the main press cylinder 45 are connected to the control center 180 by signal transmitting lines 227, 228.

The linear actuator or fluid cylinder 231 interconnected between the housing 12 and the discharge door 98 is operable to move the door 98 between its open and closed positions. The fluid cylinder 211 is connected to a solenoid control valve 232 having extend, contract and hold positions of adjustment by fluid lines 233, 234. Control lines 236, 237 connect the control valve 232 to the control center 180 and fluid conduits 238, 239 connect the control valve 232 to the pressure side of the pump 186 and the reservoir 189, respectively. The solenoid valve 232 is controlled by the control center through electric lines 241, 242 interconnecting the control valve 232 with the control center 180. Position sensors in the fluid cylinder 231 sense door open and door closed positions and are connected to the control center 180 by signal lines 243, 244. A solenoid control valve 302 for operating the loader cylinder 301 is connected in pressure fluid receiving relation to the output of the pump 186 by a fluid conduit 303 and is connected to the reservoir 189 by a fluid return conduit 304. The control valve 302 is connected to the loader cylinder 300 by conduits 306, 307. The solenoid valve 302 is connected electrically to the control center 180 by lines 308, 309. The illustrated valves 182, 216, 232 and 302 all have extend, contract and hold positions of adjustment and are spring biased to their hold position.

The control center 180 for the press control system includes a control panel 320 carrying push button switches and signal devices. Push button 321 is an emergency stop button which, when depressed, operates a switch, not shown, to stop operation of the press by disconnecting electric power when depressed causes the pump motor 187 from an electric power source 314. Push button 322 is a start button which switch the control system between the pump motor to be connected to the power source 314. Push button 323 is used to switch the control system between manual and automatic modes of press control. Button 324, when pressed, stops an automatic cycle and converts the control system to manual control. It is in effect an emergency control button. Indicator 326 is a shear alarm which lights up and energizes an audible alarm when the prepress ram 71 shearingly engages a foreign item at the feed opening 34 causing pressure in the prepress cylinder to exceed 150 pounds per square inch. An indicator 327 lights up and an alarm associated therewith sounds whenever the discharge door 98 is in its open position. An indicator 328 lights up when hydraulic fluid level is low. An indicator 329 lights up when the prepress cylinder 62 is in its extended position. An indicator 331 lights up when the main press cylinder 45 is in its contracted position. An indicator 332 lights up when the door operating cylinder is in its contracted position. When all three indicators 329, 331, 332 are lit, the operator knows the press is ready to begin a cycle of feeding and pressing oil filters. Push buttons 333 and 334 when individually pressed cause the prepress cylinder 62 to extend and contract, respectively, during manual operation of the control system. Push buttons 335, 336 are likewise used to extend and retract the main press cylinder 48 by manual rather than automatic control. Push buttons 337 and 338 are used during manual control of the control system to cause extension and contraction of the discharge door cylinder 231. Control buttons 341,342 are used to control fluid to the control valve 302 to raise and lower the feed hopper 300. The feed hopper control valve 302 does not operate as part of the automatic cycle control.

The control center 180, in automatic cycle operation, causes the press to repeatedly operate the fluid cylinders 62, 45 and 231 sequentially through an oil filter pressing cycle. During lowering of the prepress cylinder 62, the control center 180 will valve 182 to switch from a cylinder extending position to a cylinder retracting position so as to cause the prepress ram 71 to retract and the control system is automatically switched from automatic control to manual control when pressure in the prepress cylinder 62 exceeds 150 psi and the lower end of the prepress ram 71 is not below the lower edge of the feed window 34. The aforesaid excessive pressure, due to an obstruction at the feed window, causes the signal light 326 to glow and an audible alarm associates therewith to sound.

Figure 4:
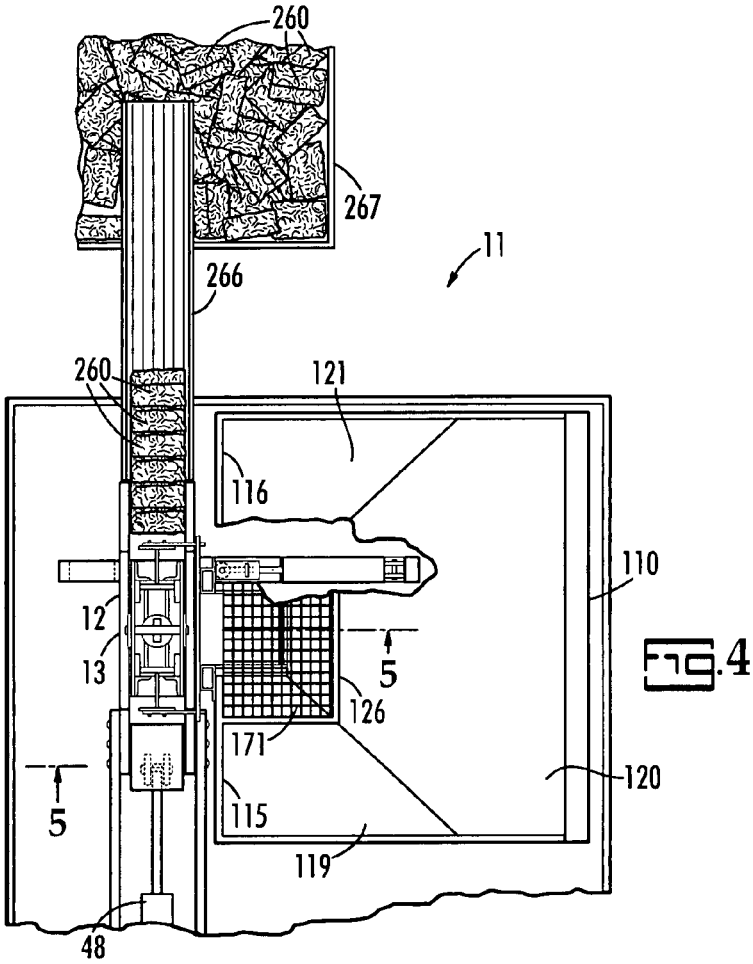
FIG. 4 is a top view of the oil filter press shown in FIGS. 1-3.
Figure 8:
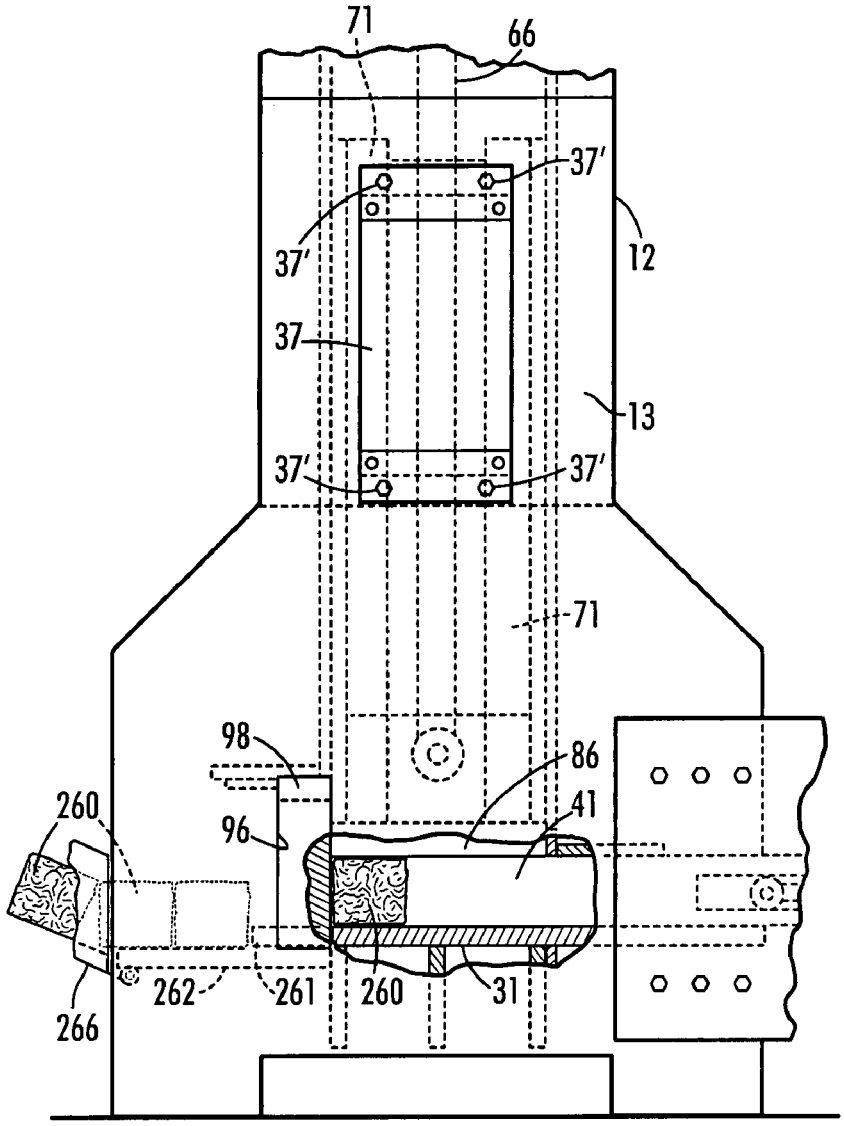
FIG. 8 is a partial rear view of the oil filter press with parts broken away to show a compressed block oil filters.
Figure 16:
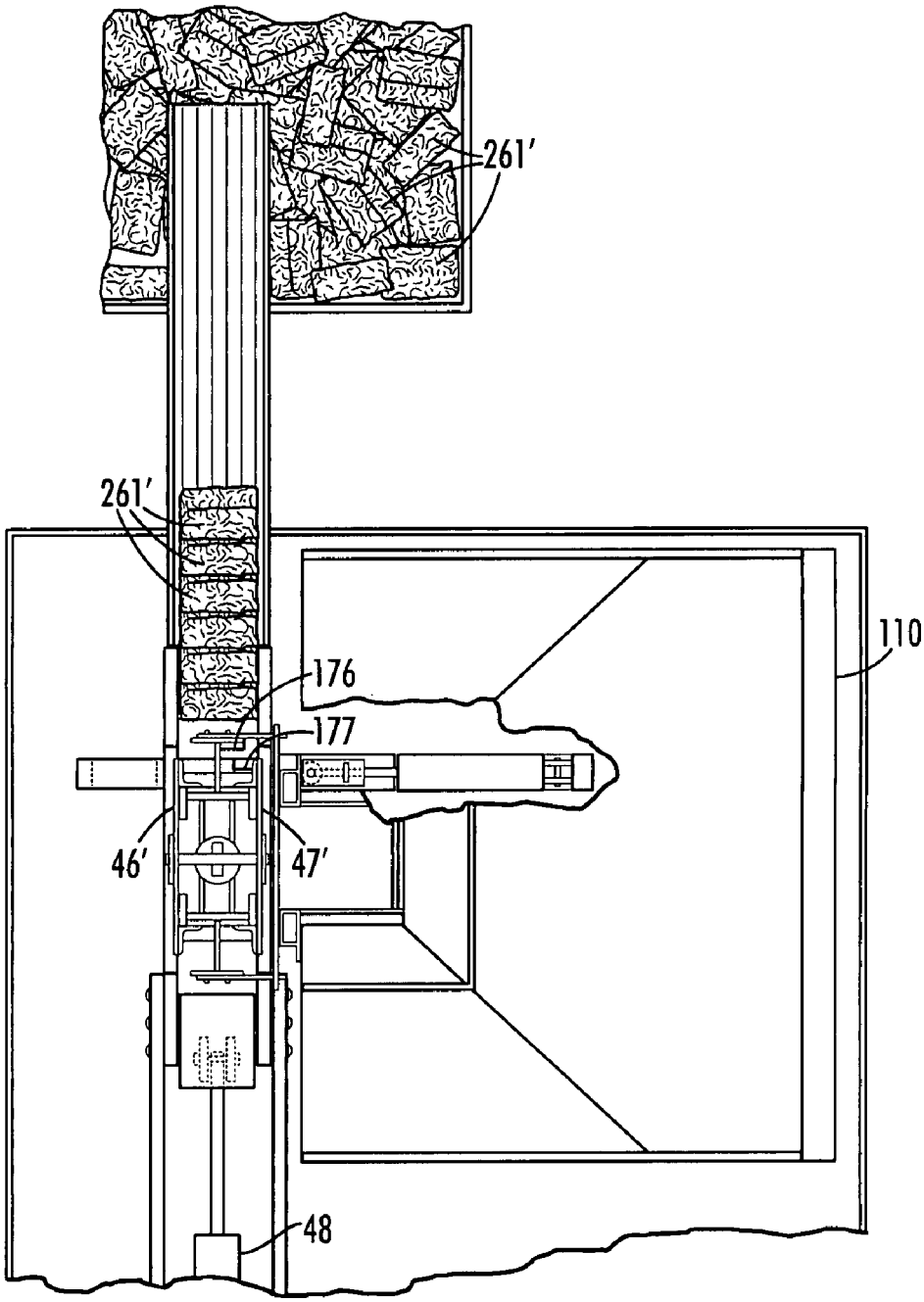
FIG. 16 is a top view similar to FIG. 4 showing a second embodiment of the oil filter press.
Figure 17:
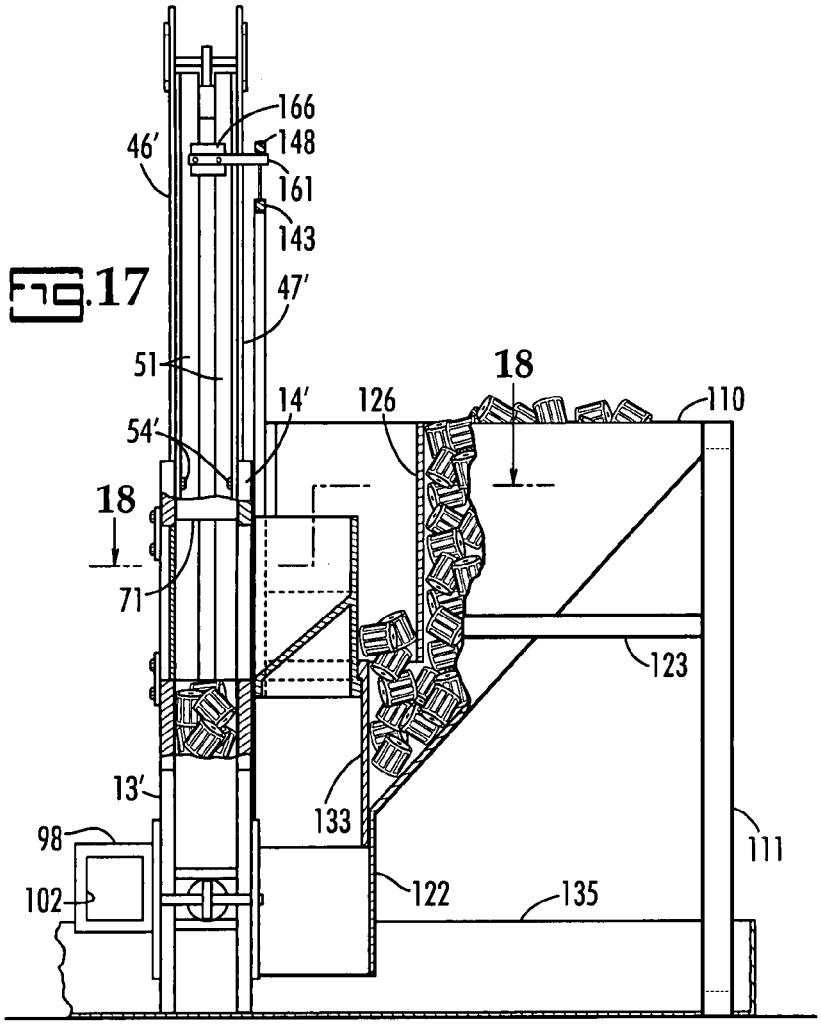
FIG. 17 is a left side view of the oil filter press shown in FIG. 16 with parts broken away to show spent oil filter cans being fed to the pre-compression chamber.
Figure 22:
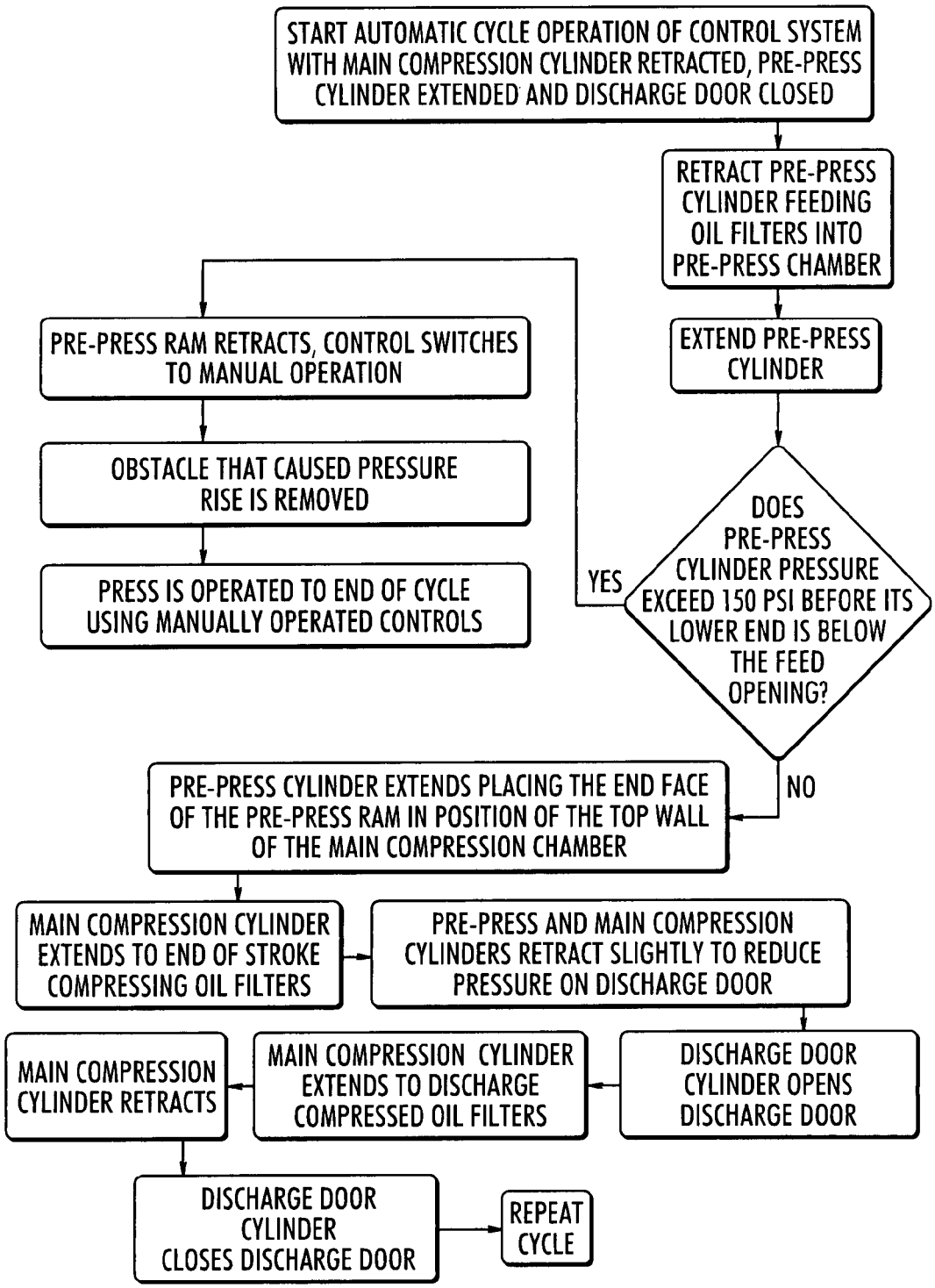
FIG. 22 is a chart illustrating the operation of the oil filter press control system.

The operator can chose between manual and automatic control of the control system for the press 11 by depressing button actuated switch 323 at the control center 180. An automatic cycle will not begin unless the proximity sensors in the cylinders 45, 62, 231 signal the control center 180 that the main ram 41 is retracted, the precompression ram 71 is extended and the discharge door 98 is closed. This is the cylinder starting position for both the manual and automatic cyclic modes of press control and when so positioned all three lights 329, 331, 332 will glow to signify that condition. At the start of a cycle the prepress cylinder 62 is retracted causing prepress ram to lift the scoop 131 full of oil filters 170 to the feed opening 34 as the lower end of prepress ram 71 moves above the feed opening 34. The sloping bottom 134 on the scoop 131 insures the prompt transfer of the filters 170 into the prepress chamber 26. The prepress cylinder 62 next extends to cause the prepress ram 71 to initially press the filters to an intermediate reduced volume transforming the lower end of the precompression chamber 26 to the main compression chamber 32 defined by the flat lower end 87 of the prepress ram 71, the bottom wall 31, the end of the main ram 41, the door 98 and the linings 16, 17 in the side walls 13, 14. Extension of the prepress cylinder 62 is automatically stopped during an automatic cycle when the pressure sensor 204 signals the control center 180 that the fluid pressure in the cylinder 62 exceeds 3000 psi. This stage of compression is shown in FIG. 19. The main compression cylinder 45 is next extended to the end of its stroke causing the main compression ram 41 to compress the oil filters to a highly compressed block or brick 260 as shown in FIGS. 4, 8, and 16. Next the prepress and main press cylinders 62, 45 are retracted slightly to reduce the pressure exerted on the compressed block of oil filters by the prepress and main rams 71, 41. This reduction of pressure reduces the pressure exerted by the compressed filters on the door 98. Next the door 98 is opened by contraction of the door operating cylinder 231 and then the main ram is extended ejecting the compressed brick or block 260 out the door window 101 beyond a step down ledge 261 rigidly secured to a step down discharge floor 262 welded to the sides 13, 14 of the housing 12. The bottom of the window 101 in the discharge door 98 is at the same horizontal level as the top surface of the floor 31 of the housing 12. Upon retraction of the main compression ram 41, the ledge 261 prevents the bricks 260 from sliding backward down the discharge chute 266, sloping upward from the press 11 and by which the bricks 260 are fed into a suitable container 267, as shown in FIG. 4. Next the compression ram 41 is moved to its retracted position and the door 98 is shifted in its guide openings 96, 97 to its closed position shown in FIGS. 3 and 19. The press is now in condition for a repetition of its automatic operating cycle. FIG. 22 is a chart which illustrates automatic cycle operation of the press and the procedure followed when an obstacle is encountered by the prepress ram 71 at the feed opening 234.

What is claimed is:

1. A press for compressing cans into bales comprising:

a housing having a horizontal floor, first and second pairs of horizontally spaced parallel vertical side walls rigidly interconnected and extending upwardly in relation to said floor forming a vertically elongated precompression chamber having a rectangular cross section, said first pair of vertical side walls extending to and secured to said floor, a precompression ram in said precompression chamber vertically shiftable between raised and lowered positions and having a flat horizontal lower end, the lower end of one wall of said second pair of vertical walls terminating at the vertical elevation of said lower end of said precompression ram in its lowered position to form an opening for said main compression ram and the lower end of the other wall of said second pair of vertical walls terminating above the vertical elevation of said lower end of said precompression ram in its lowered position to form a discharge opening which is larger in vertical dimension than the opening for said main compression ram, a sliding door at said discharge opening, shiftable between open and closed positions, a main compression ram disposed for horizontal reciprocation through said opening for said main compression ram having a compression end face, said housing including a main compression chamber formed at the lower end of said precompression chamber by said horizontal floor, said first pair of vertical walls, the lower end of said precompression ram when in its lowered position, said door and said end face of said main compression ram, a feed opening in one wall of said first pair of walls and a clean out window in the other wall of said first pair of walls, a can feed hopper adjacent said one wall of said first pair of walls including a shaft at its bottom, a feed chute adjacent said one wall of said first pair of walls including a scoop at its lower end, said feed chute being vertically reciprocatable between a lowered position in which said scoop is in said shaft for receiving cans and a raised position in which said scoop discharges cans into said precompression chamber, and vertically engageable members on said chute and said precompression ram moving said chute between said lowered and raised positions upon said precompression ram moving between its lowered raised and positions, respectively.

2. The press of claim 1 wherein said feed hopper is secured to said one wall of said first pair of walls, said feed hopper including a baffle serving to regulate the amount of spent filters picked up by said scoop.

3. The press of claim 2 including a cover for said baffle.

4. The press of claim 3 including a skirt disposed between said scoop and said scoop, said skirt being telescopically connected to said scoop.

5. The press of claim 4 wherein said scoop has a sloping bottom facilitating discharge of spent filters into said precompression chamber.

6. The press of claim 2 wherein said vertically engageable members include a pair of arms each connected to said precompression ram by connectors including a shear pin.

7. The press of claim 6 wherein said vertically engageable members have a lost motion connection.

8. A press for compressing cans into bales comprising:

a main compression ram disposed for horizontal reciprocation having a horizontally facing compression end, a housing having a horizontal floor, first and second pairs of horizontally spaced parallel vertical walls rigidly secured to and disposed above said floor forming a vertically elongated pre-compression chamber having a rectangular cross section, said first pair of vertical walls extending downwardly to said floor, one of said first pair of walls having a feed opening for cans intermediate its upper and lower ends one of said second pair of vertical walls having a horizontal lower end disposed a predetermined distance above said floor thereby defining an opening for said main ram, the other wall of said second pair of vertical walls having a horizontal lower end disposed a predetermined distance above said floor thereby defining a discharge opening, and a door in said discharge opening shiftable between open and closed positions, a pair of parallel support members secured to and extending upwardly from said first pair of side walls, a precompression ram in said precompression chamber vertically adjustable between raised and lowered positions and having a flat horizontal lower end, a double acting linear fluid actuator interconnected between said support members and said precompression ram, said actuator being operable upon contraction to raise said precompression ram and being operable upon extension to lower said precompression ram, a main compression chamber formed at the lower end of said precompression chamber by said horizontal floor, said first pair of vertical walls, the lower end of said precompression ram when in its lowered position, said compression end of said main compression ram and said door, a hopper for cans, and a feed chute for moving cans from said hopper to said feed opening, said feed chute being connected to and for linear vertical movement with said precompression ram.

9. The press of claim 8 having a control center, a position sensor supported on said housing and connected in signal delivery relation to said control center, said position sensor being operable to sense the presence of said lower end of said precompression ram below said feed window, a source of pressure fluid, a solenoid valve connected electrically to said control center, connected to said source of pressure fluid and connected to said linear fluid actuator a pair of conduits for effecting linear extension and contraction, respectively, of said linear fluid actuator, a pressure sensor connected to said conduit effecting extension of said actuator and connected in signal delivery relationship to said control center, said control center automatically adjusting said solenoid valve to cause said actuator to retract thereby raising said precompression ram when pressure in said conduit delivering fluid to said cylinder to extend it exceeds a predetermined valve providing said position sensor does not sense that said precompression ram as being below said feed window.

10. A press for compressing cans into bales comprising:

a main compression ram disposed for horizontal reciprocation having a horizontally facing compression end, shiftable between retracted and extended positions, a housing having a horizontal floor and first and second pairs of horizontally spaced parallel vertical walls disposed above said floor forming a vertically elongated pre-compression chamber having a rectangular cross section, said first pair of vertical walls having lower ends rigidly secured to said floor, said second pair of vertical walls having horizontal lower ends disposed above said floor thereby defining an opening for said main ram and a discharge opening, a door connected to said housing and shiftable between open and closed positions in which said discharge opening is open and closed, respectively, one of said vertical walls having a feed opening for receiving cans to be compressed, a precompression ram in said precompression chamber vertically adjustable between raised and lowered positions and having a flat horizontal lower end, a main compression chamber formed at the lower end of said precompression chamber by said horizontal floor, said first pair of vertical walls, the lower end of said precompression ram when in its lowered position, said compression end of said main compression ram in its extended position and said door when in its closed position, a double action linear fluid actuator operatively interposed between main compression ram and said housing, a double acting linear fluid actuator operatively interposed between said precompression ram and said housing;

a double acting linear fluid actuator operatively interposed between said door and said housing operable to move said door between its open and closed positions, a feed hopper for cans including a shaft at its bottom adjacent to said vertical wall with said feed opening, a feed chute in juxtaposed relation to said vertical wall having said feed opening, said feed chute having a scoop at its lower end and having a connection with said precompression ram by which it is raised and lowered as said precompression ram is raised and lowered, said scoop, in the lowered condition of said feed chute, said scoop is in said shaft where it receives cans deposited in said hopper and in the raised condition of said feed chute said scoop discharges cans into said precompression chamber, a control system for said press including a computerized control center, a source of pressurized fluid, a solenoid valve for each fluid actuator connected to said source of fluid pressure and in controlled relation to said control center, each of said values have extend contact and hold positions of adjustment, said solenoid valves being connected to its associated fluid actuator by a pair of conduits, for delivery and return to fluid during operation of said press, a pressure sensor sensing fluid pressure delivered to extend each of actuators associated with said precompression and main compression rams, each of said pressure sensors being connected in data delivery relation to said computer center, proximity sensors associated with each of said fluid actuators for detecting the extended condition of said prepress ram, the contracted condition of said main compression ram and the closed position of said door, said proximity sensors being connected in data delivery relation to said control center, said control system having a manual mode of operation and a automatic mode of operation, in said automatic mode the press is operated in a cyclic manner, each cycle including operation of said actuators to effect in sequence the contraction of said precompression ram causing delivery of cans to said precompression chamber, extension of said precompression ram causing precompression of said cans, extension of said main compression ram thereby compressing said cans, slight retraction of said rams, opening of said discharge door, extension of said main compression ram to discharge compressed cans from said main compression chamber and retraction of said main compression ram.

11. The press of claim 10 including a position sensor supported on said housing and connected in signal delivery relation to said control center, said position sensor sensing the presence of said lower end of said precompression ram below said feed window, a fluid pressure sensor connected to said fluid actuator connected to said precompression ram operable to sense fluid pressure effecting extension thereof, said fluid pressure sensor being connected in signal delivery relation to said control center, said control center causing said precompression ram to be retracted and said control system to be converted to manual mode of operation when said pressure sensor senses a pressure rise before the lower end of said precompression ram passes below said feed window indicative of a shearing condition due to foreign material at said feed opening.

* * * * *